US010370915B2

(12) United States Patent
Tolley et al.

(10) Patent No.: US 10,370,915 B2
(45) Date of Patent: Aug. 6, 2019

(54) GAUGE HANGER

(71) Applicant: KOTO HOLDINGS LIMITED, Renmark, South Australia (AU)

(72) Inventors: Mark Tolley, Renmark (AU); Matthew Waters, Renmark (AU); Matthew Bolsover, Renmark (AU); Philip March, Renmark (AU); Karl Beardsley, Renmark (AU); Peter Biddlestone, Renmark (AU)

( * ) Notice: Subject to any disclaimer, the term of this patent is extended or adjusted under 35 U.S.C. 154(b) by 0 days.

(21) Appl. No.: 15/302,162

(22) PCT Filed: Mar. 24, 2015

(86) PCT No.: PCT/IB2015/052144
§ 371 (c)(1),
(2) Date: Oct. 5, 2016

(87) PCT Pub. No.: WO2015/155617
PCT Pub. Date: Oct. 15, 2015

(65) Prior Publication Data

US 2017/0022772 A1 Jan. 26, 2017

(30) Foreign Application Priority Data

Apr. 8, 2014 (GB) ..... 1406299.6

(51) Int. Cl.
*E21B 23/01* (2006.01)
*E21B 47/01* (2012.01)
*E21B 47/18* (2012.01)

(52) U.S. Cl.
CPC ..... *E21B 23/01* (2013.01); *E21B 47/01* (2013.01); *E21B 47/18* (2013.01)

(58) Field of Classification Search
CPC ..... E21B 23/01; E21B 47/01; E21B 47/18
See application file for complete search history.

(56) References Cited

U.S. PATENT DOCUMENTS 4,610,309 A 9/1986 O'Brien et al.
5,438,169 A 8/1995 Kennedy et al.
(Continued)

FOREIGN PATENT DOCUMENTS

EP 1281834 A1 2/2003
GB 2435778 A 9/2007
(Continued)

OTHER PUBLICATIONS

GB Search Report for GB 1406299.6.
PCT Search Report for PCT/IB2015/052144.

*Primary Examiner* — David J Bagnell
*Assistant Examiner* — Yanick A Akaragwe

(57) ABSTRACT

A gauge hanger 10 and a setting tool 12 are disclosed. The setting tool 12 includes an electro-mechanical impact driver 26 and a drive shaft 28 which extends out of an outer casing 12. The gauge hanger 10 comprises a nut 32 which can be engaged by the drive shaft 28. When the nut 32 is rotated it can draw a threaded mandrel 36 upwardly in a wellbore. This causes the grippers 40 in a linkage assembly to be driven radially outwardly so that they can grip the sides of the wellbore. A pin 52 is designed to shear once the grippers have engaged with the sides of the wellbore so that the setting tool 12 can be lifted clear.

16 Claims, 3 Drawing Sheets

(56) References Cited

U.S. PATENT DOCUMENTS

| | | | | |
|---|---|---|---|---|
| RE36,526 | E * | 1/2000 | Braddick | E21B 7/061 166/117.6 |
| 6,325,148 | B1 * | 12/2001 | Trahan | E21B 23/00 166/137 |
| 2005/0263280 | A1 | 12/2005 | Sellers et al. | |
| 2011/0067926 | A1 * | 3/2011 | Moore | E21B 4/04 175/325.3 |
| 2011/0272145 | A1 | 11/2011 | Crawford et al. | |

FOREIGN PATENT DOCUMENTS

| | | | |
|---|---|---|---|
| WO | 2009085732 | A2 | 7/2009 |
| WO | 2011005519 | A2 | 1/2011 |

* cited by examiner

GAUGE HANGER

FIELD OF THE INVENTION

This invention relates to a gauge hanger and a setting tool for use in the tubing in a wellbore.

BACKGROUND OF THE INVENTION

A gauge hanger is a device that can be positioned in a wellbore to support operational or analysis instruments. A gauge hanger is typically lowered to a desired depth inside tubing in a drilled wellbore on a wireline or workstring. The gauge hanger is set in place by driving grippers radially outwardly with respect to the main axis of the wellbore so that a firm grip is established with the tubing.

One use of a gauge hanger is to support an acoustic gauge system, such as the AD250 produced by Acoustic Data Limited. The AD250 is an acoustic telemetry device that is designed to measure wellbore pressure in real-time. The measurement can then be converted into encoded acoustic wave data and sent to surface as a vibration inside the steel wall of the wellbore tubing. These acoustic waves can be detected by an accelerometer that is bolted to a wellhead. In this way, a device such as the AD250 can provide real-time data about wellbore pressure during production.

A number of techniques exist for setting the gauge hanger in place at a desired depth in the wellbore. These techniques typically involve explosive chemical reactions, or hydraulic/electro-hydraulic processes to provide a driving force. These actuation methods provide a high setting force, which is necessary to fix the gauge hanger securely since there can be high pressures, temperatures and vibrations in the wellbore. Additionally, these techniques provide reliable actuation, which is important when the setting process occurs at a significant depth in an inhospitable wellbore.

An electromechanical actuation device for a gauge hanger is described in WO 2009/085732. In this document a power rod is provided for longitudinal movement along a wellbore. The longitudinal movement of the power rod causes a radial movement of slips which can engage the tubing in the wellbore to set the actuator in place. The electromechanical actuator can then be released and lifted out of the wellbore.

SUMMARY OF THE INVENTION

An object of the invention is to provide a low-cost and compact design for a gauge hanger, and a corresponding method for setting the gauge hanger in tubing in a wellbore.

According to the present invention there is provided a gauge hanger for tubing in a wellbore, comprising: at least one gripper configured for radial movement in the tubing in order to grip a side of the tubing; a rotatable element; a transfer mechanism connected to the rotatable element and configured to transfer rotational movement of the rotatable element into a radial movement of the at least one gripper so that rotation of the rotatable element drives the gripper radially outwardly to grip the side of the tubing; and a connector configured to assemble the rotatable element to a rotatable drive unit, wherein the connector is configured to disengage when the at least one gripper has gripped the side of the tubing.

In this way, the gauge hanger can be set in tubing by rotating the rotatable element. This is an entirely different approach for setting a gauge hanger in tubing. It is advantageous because it enables a low-cost and compact design. It has been found that a sufficient gripping force can be applied to tubing through the gripper by making use of a high torque electro mechanical setting tool, such as an impact driver. However, the rotatable element also allows the gauge hanger to be set by hand, if required.

Preferably the rotatable element is one of a threaded bar and a cooperating nut. Thus, a relative rotation of the nut and threaded bar may be converted to radial movement of at least one gripper using the transfer mechanism. It has been found that this is a particularly convenient mechanism for converting rotational movement in the rotatable drive unit into an axial movement along the wellbore. This axial movement can then be converted into a radial movement using the transfer mechanism.

Preferably the connector is configured to disengage when a predetermined torque is applied to it. It has been found that this is a particularly convenient technique for disengaging the gauge hanger from the rotatable drive unit once it has been set in place. The load on the drive unit increases significantly when the gripper moves into contact with the tubing, and this increases the torque on the connector. The connector can disengage when this increase in torque is applied so that the rotatable drive unit can be lifted clear.

The connector may be a pin that is designed to shear upon application of the predetermined torque. The pin can extend through the rotatable element so that torque can be applied by the rotatable drive unit. It is desirable to sever the connection between the setting tool and the gauge hanger using a simple mechanical technique to avoid any errors or complication arising in the inaccessible and inhospitable environment of a wellbore.

The gauge hanger may comprise a biasing device, configured to bias the at least one gripper towards the side of the tubing. The biasing device may be a spring, such as a stack of Belleville washers. The biasing device may be useful so that a gripping force can be maintained even in the event of movement in the tubing. This means that the gauge hanger can stay firmly in place.

The biasing device may be a compressible spring which is provided between the rotatable element and at least one gripper, possibly in the transfer mechanism. Preferably the biasing force is substantially established in the biasing device after the gripper engages the side of the tubing. In this way the biasing device substantially affects the grippers only after the gauge hanger has been set.

Typically the biasing device is compressed in proportion to the force on it, and in dependence on the value of the spring constant. Before the grippers have engaged the side of the wellbore the force on the spring may be sufficient only for a slight compression. After this point the force on the spring may be increased significantly so that it compresses substantially and creates a biasing/retaining force in the gripper.

The transfer mechanism may include a component that is moveable relative to the rotatable element when the compressible spring is compressed. In this way the rotatable element can remain in a fixed axial position in the wellbore once the grippers have engaged the sides of the tubing. A moveable component in the transfer mechanism may therefore allow the spring to compress while the gauge hanger is fixed in place.

The moveable element is preferably a nut that can rotate relative to a threaded bar. The nut can therefore move axially in the bore, relative to the threaded bar, so that the spring can compress.

In one embodiment the moveable nut may be provided in a position between the rotatable element and at least one gripper. In this embodiment the nut may comprise a portion that is moveable relative to the rotatable element, and a portion that is fixed relative to the rotatable element. It has been found that this creates a compact design for the gauge hanger, which is desirable.

Preferably the gauge hanger includes a locking device for resisting movement of the at least one gripper towards the main axis of the bore. In one embodiment a ratchet may be provided in this regard. In another embodiment a nut on a threaded bar may resist unthreading if the strength of interaction is high.

According to another aspect of the invention there is provided a gauge hanger and setting tool combination comprising the gauge hanger as defined above and a setting tool comprising the rotatable drive unit that is assembled to the rotatable element with the connector.

Preferably the rotatable drive unit is an electro-mechanical impact driver. It has been found that these impact drivers can supply a torque of 50-100 Nm, which is sufficient to set the gauge hanger securely in the wellbore.

According to another aspect of the invention there is provided a method of setting a gauge hanger in tubing in a wellbore, comprising the steps of: connecting a rotatable element in the gauge hanger to a setting tool including a rotatable drive unit, rotating the rotatable element in the gauge hanger using the rotatable drive unit; transferring rotational movement of the rotatable element into a radial movement of at least one gripper, using a transfer mechanism; driving the at least one gripper into engagement with the side of the tubing so that the gauge hanger is set in place; disconnecting the rotatable element from the rotatable drive unit once at least one gripper has gripped the side of the tubing so that the setting tool can be lifted clear of the gauge hanger in the wellbore.

Method features may be provided as corresponding apparatus features and vice-versa.

BRIEF DESCRIPTION OF THE DRAWINGS

Embodiments of the present invention will now be described, by way of example only, with reference to the accompanying drawings in which.

DETAILED DESCRIPTION OF THE INVENTION

Figure 1:
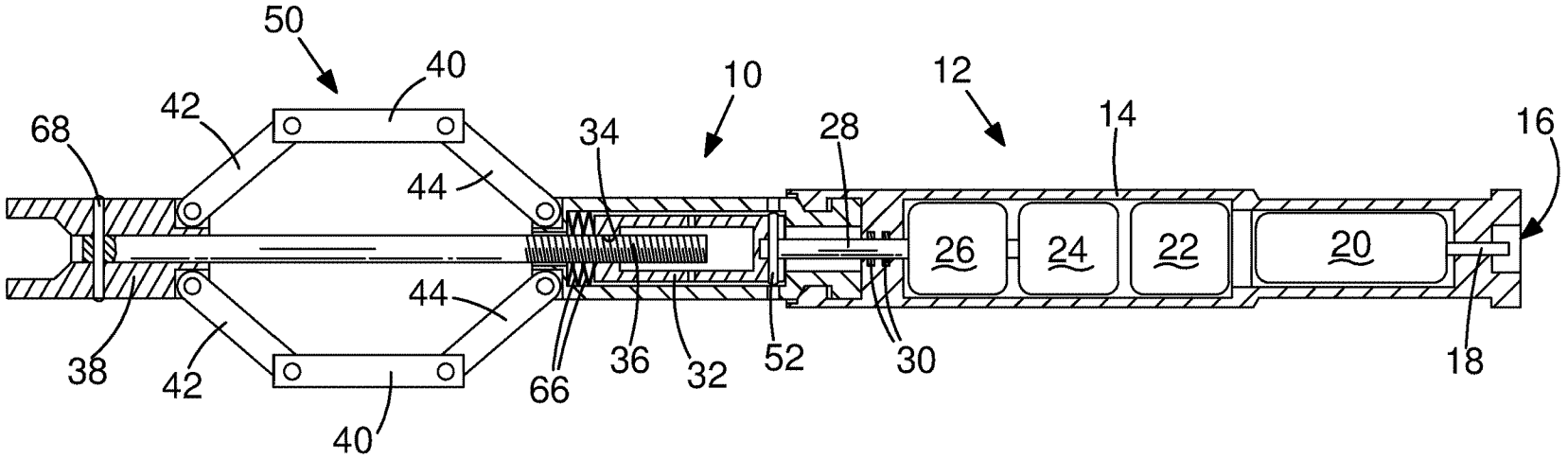
FIG. 1 is a cross-sectional view of a gauge hanger and setting tool in an embodiment of the invention.

FIG. 1 is a cross-sectional view of a gauge hanger 10 and a setting tool 12. The setting tool 12 includes an outer casing 14 that is hermetically sealed to protect inner components. A fishing head 16 is provided at the upper end of the setting tool 12 for attachment to a wire line rope socket (not shown). Sealed within the outer casing 14 is an on/off switch 18, a battery pack 20, an electronics module 22, a 10.5V DC motor 24, and an 'impact driver' head 26.

The impact driver head 26 is connected to a cylindrical drive shaft 28, which extends out of the sealed outer casing 14. A thrust bearing and seals 30 are provided for this purpose at the bottom of the setting tool.

The impact driver head 26 comprises a relatively heavy outer sleeve that surrounds an inner core. The outer sleeve and 10.5V DC motor 24 are splined to the setting tool body 14. In this way the impact driver head 26 can convert the rotational inertia of the inner core to the cylindrical drive shaft 28 to generate significant torque. This torque is then applied to the cylindrical drive shaft 28, and it is used for setting the gauge hanger in place.

The gauge hanger 10 includes an outer casing 31. The setting tool 12 includes a female connector 74 that can receive a male connector 72 on the gauge hanger 10. A slot 76 in the male connector 72 can engage a projection 78 in the female connector 74. In this way, the outer casing 31 of the gauge hanger is connected to the outer casing 14 of the setting tool 12 using an anti-rotation coupling. These outer casings 14, 31 can therefore remain stationary in the wellbore while inner components are rotated. The anti-rotation coupling can absorb any impacts on the gauge hanger 10 and setting tool 12 that may be experienced while the combination is lowered in the wellbore. This is useful as it means that a shear pin 52 is shielded from any impacts that could otherwise weaken it in the lowering process.

The gauge hanger 10 includes a nut 32, which can be engaged by the drive shaft 28. At its lower end the nut 32 has an internal thread 34 that can engage with an external thread on a bar or mandrel 36. Thus, when the drive shaft 28 rotates the nut 32 clockwise it can draw the mandrel 36 upwards in the wellbore.

At its lower end the threaded mandrel 36 is attached to a gauge attachment portion 38, from which tools and/or instruments can be hung. A linkage assembly 50 is provided between the gauge attachment portion 38 and a lower end of the outer casing 31. The linkage assembly 50 includes hanger arms 42 that are pivotally attached on one side to the gauge attachment portion 38 and on the other side to a gripper 40. Hanger arms 44 are also provided and they are pivotally attached at one side to the lower end of the outer casing 31, and at the other side to the gripper 40. Thus, the grippers 40 are driven radially outwardly when the distance between the gauge attachment portion 38 and the lower end of the outer casing 31 is decreased. This can be achieved by rotating the nut 32 and drawing the mandrel 36 vertically upwards in the wellbore. For presentational simplicity, only two grippers 40 are shown in FIG. 1. In other embodiments of the invention it would be desirable to provide three or more grippers 40 with respective hanger arms 42, 44.

The gauge hanger 10 is assembled to the setting tool 12 outside of the wellbore so that they can be lowered together. This is achieved by driving a shear pin 52 through a bore 54 in the nut 32 and a bore 56 in the drive shaft 28. A hole 58 is provided in the outer casing 31 of the gauge hanger 10 so that the pin 52 can be fitted in place when all of the holes 54, 56, 58 are aligned. The shear pin 52 is designed to transfer rotational energy from the drive shaft 28 to the nut 32 when the impact driver 26 is in operation. The shear pin 52 is designed to withstand a predetermined torque, and it is designed to shear when this predetermined torque is exceeded.

The nut 32 includes an upper half 60 and a lower half 62, which are assembled together using inter-locking fingers 64. The inter-locking fingers 64 resist relative rotational movement of the upper and lower halves 60, 62, but they permit relative axial movement. A stack of Belleville washers 66 is provided between the lower half 62 of the nut 32 and an interior surface of the outer casing 31.

In operation the electric motor 24 is energized and the impact driver 26 rotates the drive shaft 28. In turn, the drive shaft 28 rotates the nut 32, via the shear pin 52. All of these components rotate together, provided the force on the shear pin is below the maximum tolerance. As the nut 32 rotates the threaded mandrel 36 is drawn upwards in the wellbore, and the gap between the gauge attachment portion 38 and the lower end of the outer casing 31 is reduced. The linkage assembly 50 is then axially compressed which causes the grippers 40 to be driven radially outwardly in the tubing. On contacting a surface of the tubing the grippers 40 take hold so that the gauge hanger 10 can be secured in place. A strong attachment is created, to the extent that the tubing is nearly deformed. At this point the gauge hanger 10 and the setting tool 12 are fixed in place in the wellbore. The strength of interaction between the nut 32 and the mandrel 36 is sufficient to resist unthreading. In some arrangements it may be desirable to provide a flat ratchet (not shown) adjacent the nut 32 to resist counter-rotation relative to the mandrel 36.

As the grippers 40 contact the tubing the return force or resistance is increased on all of the components in the driving mechanism. The gauge hanger 10 includes a stack of Belleville washers 66 between the lower half 62 of the nut 32 and a surface of the outer casing 31. As the force between the nut 32 and the threaded mandrel 36 increases the Belleville washers 66 are compressed. Typically the compression of the Belleville washers 66 will increase after the gauge hanger 10 is set in place such that the grippers 40 can no longer move radially outwardly. After this point the compression of the Belleville washers 66 allows the nut 32 to continue to rotate, drawing the threaded mandrel 36 yet further axially upwards in the wellbore. The compression of the Belleville washers 66 is desirable because it creates a biasing/retaining force in the grippers 40. Thus, the gauge hanger 10 can remain set in place, even if there are vibrations or movements in the wellbore that would otherwise decrease the strength of interaction between the grippers 40 and the side of the tubing.

In order for the Belleville washers 66 to be compressed the lower half 62 of the nut 32 is arranged to slide axially downwards relative to the upper half 60. This is achieved because the lower half 62 is axially moveable relative to the upper half 60, which is axially fixed relative to the setting tool 12 with the shear pin 52. It is desirable to maintain the upper half 60 of the nut 32 in a fixed position relative to the drive shaft 28 so that a secure connection between the setting tool 12 and the gauge hanger 10 is maintained with the shear pin 52.

The nut 32 will continue to rotate, driven by the impact driver 26, until the force on the shear pin 52 exceeds a predetermined threshold. This threshold may be exceeded after the Belleville washers 66 have been compressed by a predetermined amount. At this point the pin 52 will shear, disengaging the nut 32 from the cylindrical drive shaft 28. The setting tool 12 can then be lifted clear from the gauge hanger 10. The gauge hanger 10 can then remain in place to hold a device that is designed to measure wellbore pressure in real-time to monitor conditions during the production phase of the wellbore.

The gauge hanger 12 also includes a second shear pin 68 attached to the threaded mandrel 36 in the gauge attachment portion 38. The second shear pin 68 typically has a higher strength than the first shear pin 52, and it is designed to shear only when the gauge hanger is to be removed from the wellbore. This is achieved by dropping a disengagement tool (not shown) down the well and connecting it to the top of the gauge hanger 10. The disengagement tool is designed to pull the outer casing 31 upwards with a high force such that the second pin 68 shears, releasing the threaded mandrel 36 from the gauge attachment portion 38. The linkage assembly 50 can then be extended so that the grippers 40 move radially inwards in the tubing. The gauge hanger 10 can then be lifted out of the wellbore.

Figure 3:
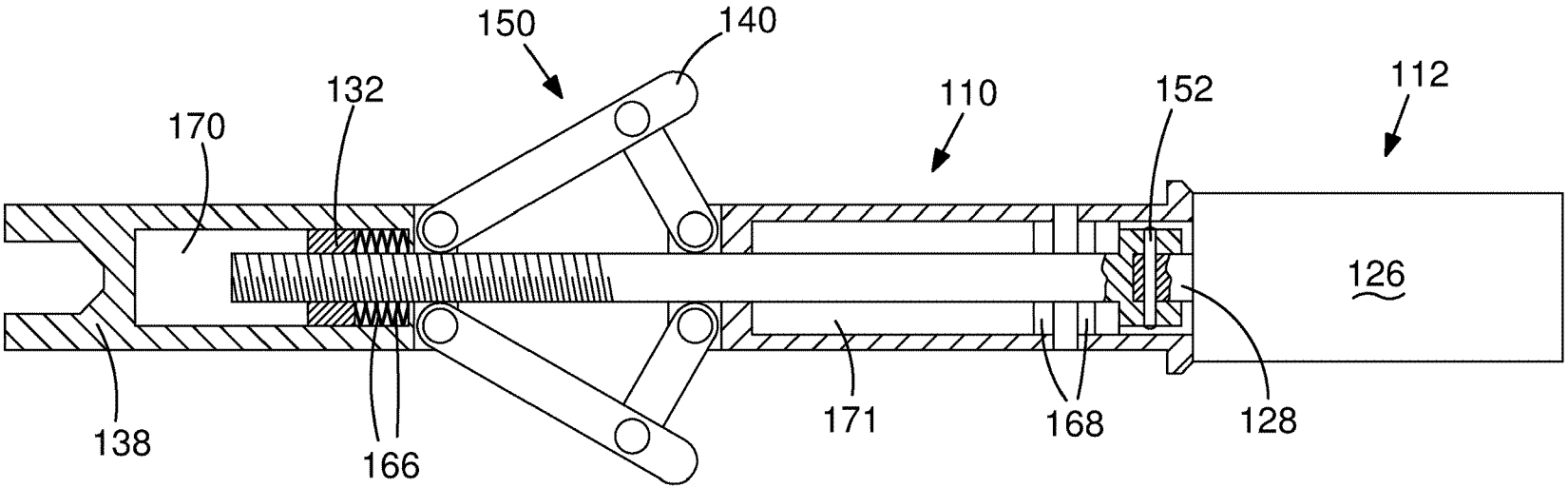
FIG. 3 is a cross-sectional view of a gauge hanger and setting tool in another embodiment of the invention.

FIG. 3 is a cross-sectional view of a setting tool 112 and gauge hanger 110 in another embodiment of the invention. In this embodiment the setting tool 112 includes an impact driver 126 which is connected to a cylindrical drive shaft 128. A shear pin 152 connects the cylindrical drive shaft to the threaded mandrel 136 in the gauge hanger 110. The threaded mandrel 136 is connected to a nut 132 at its lower end so that rotation of the mandrel 136 draws the nut 132 upwards in the wellbore. A linkage assembly 150 is provided between the gauge attachment portion 138 and the body of the gauge hanger 110 so that grippers 140 in the linkage assembly 150 are driven radially outwards in the wellbore when the mandrel 136 is screwed into the nut 132.

In this embodiment a first cavity 170 is provided in the gauge attachment portion 138 and a second cavity 171 is provided in the gauge hanger main body 110. A stack of Belleville washers 166 is provided in the cavity 170, between the top of the nut 132 and an upper internal surface of the gauge attachment portion 138. In this way the Belleville washers 166 act like a spring that can be compressed when the reaction force between the nut 132 and the internal surface of the gauge attachment portion 138 is high enough. This typically occurs after the grippers 140 have contacted the side of the tubing. After this point the mandrel 136 continues to be rotated and the nut 132 travels upwards within the cavity 170 so that the Belleville washers 166 can be compressed. This creates a biasing/retaining force that pushes the grippers 140 radially outward in the tubing. The cavity 170 and the nut 132 are machined to permit axial movement of the nut 32, but to resist rotational movement.

The pin 152 is designed to shear when a predetermined force is exceeded so that the setting tool 112 can be disengaged and lifted clear. Typically the pin 152 is designed to shear after the Belleville washers 166 have been compressed to a certain extent.

The gauge hanger 110 includes two other identical shear pins 168 which are designed to shear so that the grippers 140 can be disengaged from the tubing. This is achieved by dropping a disengagement tool in the wellbore, connecting it to the gauge hanger 110, and providing an upward impact force to the threaded mandrel 136. This upward force causes the pins 168 to shear so that the gauge hanger 110 moves axially upward in the wellbore. The bottom of the threaded mandrel 136 then moves downwards in the cavity 170 so that the linkage assembly 150 can straighten and the grippers 140 can move away from the side of the tubing. The gauge hanger 110 can then be lifted clear of the wellbore.

Figure 2:
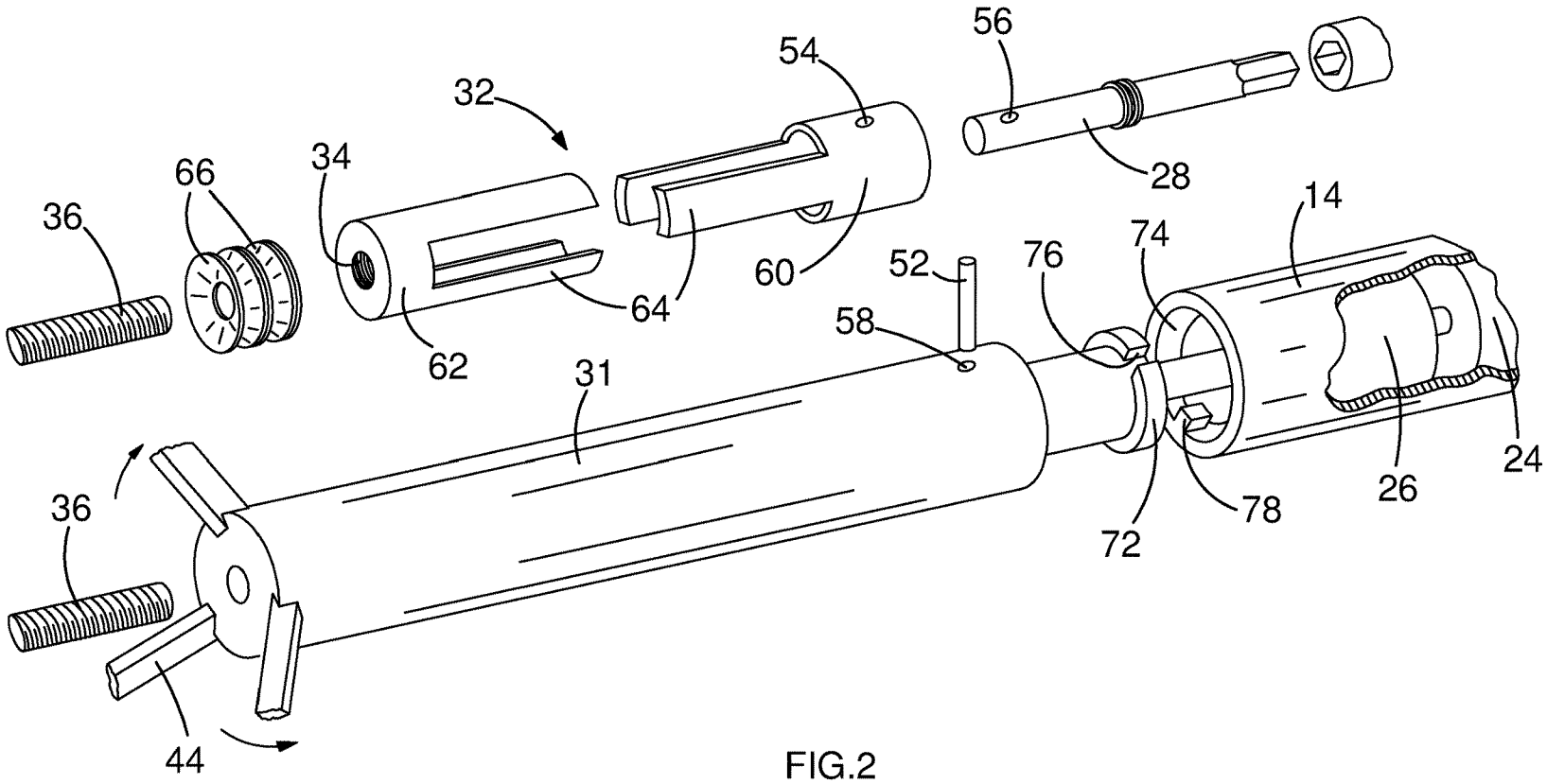
FIG. 2 is an exploded view of a gauge hanger and setting tool in an embodiment of the invention.

In the second embodiment shown in FIG. 3 it is necessary to provide the cavity 171 in the gauge hanger 110 so that the threaded mandrel can move downwardly when the second pin 168 is sheared. The cavity 171 lengthens the gauge hanger 110 somewhat in comparison to the gauge hanger 10 in the first embodiment. Therefore, the design of the first embodiment, shown in FIGS. 1 and 2 is slightly preferred.

The invention claimed is:

1. A gauge hanger for tubing in a wellbore, comprising:

at least one gripper configured for radial movement in the wellbore in order to grip a side of the tubing;

a rotatable element;

a transfer mechanism connected to the rotatable element and configured to transfer rotational movement of the rotatable element into a radial movement of the at least one gripper so that rotation of the rotatable element drives the gripper radially outwardly to grip the side of the tubing; and a connector configured to assemble the rotatable element to a rotatable drive unit, wherein the connector is configured to disengage when the at least one gripper has gripped the side of the tubing so that the gauge hanger is disassembled from the rotatable drive unit.

2. The gauge hanger of claim 1 wherein the rotatable element is one of a threaded bar or a nut, and wherein relative rotation of the threaded bar or the nut is transferred to radial movement of the at least one gripper using the transfer mechanism.

3. The gauge hanger of claim 1 wherein the connector is configured to disengage when a predetermined torque is applied to it.

4. The gauge hanger of claim 3 wherein the connector is a pin that is designed to shear upon application of the predetermined torque.

5. The gauge hanger of claim 1 further comprising a biasing device, configured to bias the at least one gripper towards the side of the tubing.

6. The gauge hanger of claim 5 wherein a biasing force is substantially established in the biasing device after the gripper engages the side of the tubing.

7. The gauge hanger of claim 6 wherein the biasing device is a compressible spring which is provided between the rotatable element and the at least one gripper.

8. The gauge hanger of claim 7 wherein the transfer mechanism includes a component that is moveable relative to the rotatable element when the compressible spring is compressed.

9. The gauge hanger of claim 8 wherein the moveable component is a nut that can rotate relative to a threaded bar.

10. The gauge hanger of claim 9 wherein the nut is provided between the rotatable element and the at least one gripper.

11. The gauge hanger of claim 10 wherein the nut comprises a portion that is moveable relative to the rotatable element, and a portion that is fixed relative to the rotatable element.

12. The gauge hanger of claim 1 wherein the transfer mechanism includes a locking device for resisting movement of the at least one gripper away from the main axis of the tubing.

13. The gauge hanger of claim 1 comprising a ratchet for resisting a counter-rotation of the rotatable element that would move at least one gripper away from the main axis of the tubing, via the transfer mechanism.

14. A combination comprising:

a gauge hanger for tubing in a wellbore, comprising:

at least one gripper configured for radial movement in the wellbore in order to grip a side of the tubing, a rotatable element, a transfer mechanism connected to the rotatable element and configured to transfer rotational movement of the rotatable element into a radial movement of the at least one gripper so that rotation of the rotatable element drives the gripper radially outwardly to grip the side of the tubing; and a setting tool comprising a rotatable drive unit that is operably assembled to the rotatable element of the gauge hanger, wherein the gauge hanger further comprises a connector configured to assemble the rotatable element of the gauge hanger with the rotatable drive unit of the setting tool, wherein the connector is configured to disengage when the at least one gripper has gripped the side of the tubing, thereby disengaging the gauge hanger from the setting tool.

15. The combination of claim 14, wherein the rotatable drive unit is an electro-mechanical impact driver.

16. A method of setting a gauge hanger in tubing in a wellbore, comprising the steps of:

connecting a rotatable element in the gauge hanger to a setting tool that includes a rotatable drive unit;

rotating the rotatable element in the gauge hanger using the rotatable drive unit;

transferring rotational movement of the rotatable element into a radial movement of at least one gripper, using a transfer mechanism;

driving the at least one gripper into engagement with the side of the tubing so that the gauge hanger is set in place; and disconnecting the rotatable element from the rotatable drive unit once the at least one gripper has gripped the side of the tubing so that the setting tool can be lifted clear of the gauge hanger in the wellbore.

* * * * *